US005356741A

United States Patent [19]

Carmichael et al.

[11] Patent Number: 5,356,741

[45] Date of Patent: Oct. 18, 1994

[54] CONTROL OF THE ACID/BASE ENVIRONMENT IN PHOTOCONDUCTIVE ELEMENTS

[75] Inventors: Kathleen M. Carmichael, Williamson; Sharon E. Normandin, Macedon; Donald P. Sullivan, Rochester; Edward F. Grabowski, Webster; Emery G. Tokoli, Rochester, all of N.Y.

[73] Assignee: Xerox Corporation, Stamford, Conn.

[21] Appl. No.: 71,360

[22] Filed: Jun. 3, 1993

Related U.S. Application Data

[63] Continuation of Ser. No. 815,226, Dec. 31, 1991, abandoned.

[51] Int. Cl.[5] ..... G03G 5/04

[52] U.S. Cl. ..... 430/56; 430/132

[58] Field of Search ..... 430/56, 58, 59, 64, 430/65, 132

[56] References Cited

U.S. PATENT DOCUMENTS

| | | | |
|---|---|---|---|
| 4,018,602 | 4/1977 | Chu | 96/1.5 |
| 4,106,934 | 8/1978 | Turnblom | 96/1.5 |
| 4,264,695 | 4/1981 | Kozima et al. | 430/58 |
| 4,535,042 | 8/1985 | Kitayama et al. | 430/56 |
| 4,543,314 | 9/1985 | Maxwell | 430/134 |
| 4,725,518 | 2/1988 | Carmichael et al. | 430/59 |
| 4,874,682 | 10/1989 | Scott et al. | 430/59 |
| 5,063,125 | 11/1991 | Yuh et al. | 430/59 |

*Primary Examiner*—John Goodrow

*Attorney, Agent, or Firm*—Finnegan, Henderson, Farabow, Garrett & Dunner

[57] ABSTRACT

A method of controlling variations in electrical characteristics in electrophotographic imaging devices by eliminating the effect of acidic or basic impurities in a photoconductive element. A solution of a weak acid or weak base and a conjugate salt of the weak acid and the weak base is incorporated into a layer of the photoconductive element. In a process for producing the photoconductive element, a substrate is coated with a first dispersion to form a charge generating layer, and then coated with a second dispersion to form a charge transporting layer, wherein there is incorporated in at least one of the first and second dispersions a solution of a weak acid or weak base and the conjugate salt of the weak acid and weak base in an amount effective to reduce variations in the dark development potential ($V_{DDP}$) and background potential ($V_{BG}$) characteristics of the imaging devices.

16 Claims, No Drawings

CONTROL OF THE ACID/BASE ENVIRONMENT IN PHOTOCONDUCTIVE ELEMENTS

This application is a continuation of application Ser. No. 07/815,226, filed Dec. 31, 1991, now abandoned.

FIELD OF THE INVENTION

The present invention relates in general to electrophotographic imaging and particularly to a method of improving the performance of photoconductive elements in electrophotographic imaging devices. More specifically this invention presents a novel process for controlling variations in the electrical characteristics of an electrophotographic imaging member due to the presence of acidic or basic impurities in a photoconductive element of the electrophotographic imaging member.

BACKGROUND OF THE INVENTION

In electrophotographic imaging, images are formed and developed by electrostatic means. The best known of the commercial processes, more commonly known as xerography, involves forming a latent electrostatic image on an imaging surface of a photoconductive element by first uniformly electrostatically charging the surface of the photoconductive element in the dark and then exposing this electrostatically charged surface to a light and shadow image. The light-struck areas of the imaging surface are thus rendered relatively conductive and the electrostatic charges are selectively dissipated in these irradiated areas.

After the photoconductive element is exposed to the light and shadow image, the latent electrostatic image on this image-bearing surface is rendered visible by development with a finely divided colored marking material, known in the art as toner. The toner will be principally attracted to those areas on the image-bearing surface having a polarity of charge opposite to the polarity of charge on the toner particles.

The photoconductive elements, which are also referred to as photosensitive members, electrostatographic devices, photoconductors, photoreceptors, etc., are available in a variety of configurations and compositions. As disclosed in U.S. Pat. No. 4,106,934 the photoconductive element composition may be selected from a wide variety of photoconductive and insulating materials which may be single layer compositions or multiactive layer compositions.

Photoconductive elements generally have a charge transport layer and a charge generating layer superimposed on a supporting substrate. For example, U.S. Pat. No. 4,018,602 discloses charge generating and charge transferring polymeric films coated on a supportive substrate in two adjacent layers. A solvent in one of the layers causes a softening in the other layer which initiates the formation of a charge-transfer complex at the interface of the layers.

U.S. Pat. No. 4,535,042 shows the composition of a layered electrophotographic photosensitive member. An electron acceptor layer and an electron donor layer are superimposed upon each other to form a thin layer of charge-transfer complex at the interface between the two layers.

U.S. Pat. No. 4,264,695 discloses the formation of charge-transfer complexes between electron donor and acceptor molecules, which are present in separate layers. Additionally, one of the layers may contain a photoconductive pigment.

U.S. Pat. No. 4,106,934 discloses single layer and multi-layer photoconductive insulating elements. Sensitivity of the photoconductor is increased by charge transfer complexes which are obtained by combining electron donor and acceptor pairs in conjunction with a p-type photoconductor.

A composite photoconductive element may be produced from a dispersion of a photoconductive substance and an appropriate binder which is coated on a conductive substrate. For example, U.S. Pat. No. 4,543,314 discloses a process for preparing an electrostatographic photosensitive device in which a dispersion mixture is milled and applied to a substrate in an even layer and dried.

The composition of the photoconductive element is selected to form clear image reproductions. However, the slightest presence of impurities in the system may result in a variance in electrical properties which causes low quality image reproduction.

Variations in the electrical properties of a photoconductive element result in unacceptable variance in dark development potential ($V_{DDP}$) and background potential ($V_{BG}$). $V_{DDP}$ is defined as the potential on a photoconductive element in the dark a specified time after uniform charging. Unpredictable variations in this characteristic are highly undesirable, particularly for high volume, high speed copiers, duplicators and printers which require precise, stable, and predictable photoconductive element operating ranges. Erratic variations in $V_{DDP}$ can be unacceptable, or at the very least, require expensive and sophisticated control systems or trained repair persons to alter machine operating parameters such as charging potentials, toner concentration and the like to compensate for different photoconductive element $V_{DDP}$. Failure to adequately compensate for $V_{DDP}$ differences can result in copies of poor copy quality. Moreover, such variations in $V_{DDP}$ prevent achievement of optimized $V_{DDP}$ properties.

$V_{BG}$ is defined as the potential in the background or light struck areas of a photoconductive element after exposure to a pattern of activating electromagnetic radiation such as light. Unpredictable variations in $V_{BG}$ can adversely affect copy quality, especially in complex, high volume, high speed copiers, duplicators and printers which by their very nature require photoconductive element properties to meet precise narrow operating windows. Thus, like photoconductive elements that exhibit batch to batch $V_{DDP}$ variations, photoconductive elements that have poor $V_{BG}$ characteristics are also unacceptable or require expensive and sophisticated control systems or trained repair persons to alter machine operating parameters. Inadequate compensation of $V_{BG}$ variations can cause copies to appear too light or too dark. In addition, such variations in $V_{BG}$ properties preclude optimization of $V_{BG}$ properties.

Control of both $V_{DDP}$ and $V_{BG}$ of photoconductive elements is important not only initially but through the entire cycling life of the photoconductive element. During the electrophotographic process, the photoconductive element is subjected to a series of charge and illumination steps which often produce changes in the electric and optical properties of the photoconductive element. These changes are called fatigue. Fatigue causes the operating characteristics to vary during the life of the photoconductive elements and is undesirable in actual commercial usage.

A common factor which produces variable $V_{DDP}$ and $V_{BG}$ in photoconductive elements is the small, uncontrollable variation in acidic or basic chemical impurities in the system. Additives to the photoconductive element's layer or layers may reduce or eliminate the effects of impurities. For example, U.S. Pat. No. 4,874,682 describes a monomeric or polymeric nonvolatile basic amine incorporated in a charge transport layer to eliminate the fatigue effect of acids. In another example, U.S. Pat. No. 4,725,518, the entire disclosure of which is incorporated by reference herein, discloses addition of an aromatic amine compound and a protonic acid or Lewis acid in a charge transport layer to control $V_{DDP}$ and $V_{BG}$.

Another known treatment of photoconductive elements to control acidic or basic variations affecting $V_{DDP}$ and $V_{BG}$ involves doping the photoconductive element with other acids and bases. For example, a variance in $V_{DDP}$ and $V_{BG}$ may be controlled by the addition of trifluoroacetic acid to the transport layer in amounts ranging from about 0.1 to 100 ppm. However, the actual amount varies and must be determined by frequent measurement during the manufacturing process of the electrical behavior of the device. The dopant content is readjusted to compensate for the quantity of acid necessary to achieve the desired electrical specifications. This acid doping procedure is tedious, time-consuming and difficult to predictably control.

Thus, it would be desirable to improve manufacturing processes of photoreceptors to eliminate effects of acids and bases in the photoconductive element. Further, it would be desirable to eliminate the need for variable amounts of acid or base dopant to impart the desirable electrical behavior.

SUMMARY OF THE INVENTION

An object of the invention is to provide an electrophotographic photoconductive element free from the above mentioned disadvantages of $V_{DDP}$ and $V_{BG}$ as well as having certain additional advantages discussed herein below.

It is also an object of the invention to provide a process for making such photoconductive element which eliminates the tedious and unpredictable of doping methods.

In accordance with the present invention, a method is provided for controlling variations in the electrical characteristics of an electrophotographic imaging member due to the presence of acidic or basic impurities in a photoconductive element of the imaging member. A substrate is coated with a dispersion, where the dispersion contains either a charge generating material or a charge transporting material, a solution containing a weak acid or a weak base and a conjugate salt of the weak acid and the weak base, and a binder resin. The dispersion coating is dried to form a photoconductive layer on the substrate.

It is a further objective of the invention to provide a process for producing electrophotographic imaging members. According to a preferred embodiment of the present invention, a first dispersion of a charge generating material in a binder resin is coated on a substrate and dried to form a charge generating layer. Then a second dispersion of a charge transporting material in a binder resin is coated on the charge generating layer and dried to form a charge transporting layer. In at least one of the first and second dispersions there is incorporated a solution of a weak acid or a weak base and a conjugate salt of the weak acid and the weak base. The weak acid or the weak base and the conjugate salt are incorporated in an amount effective to reduce variations in the dark development potential and background potential characteristics of the photoconductive elements due to the presence of acidic or basic impurities in the layer formed from the dispersion in which the solution is incorporated.

DETAILED DESCRIPTION OF THE INVENTION

The present method of controlling variations due to the presence of acidic or basic impurities in a photoconductive element is based on the concept of a buffer system. A buffer system may be defined as a system having a substance capable of neutralizing both acids and bases and thereby maintaining the original acidity or basicity of the system.

The buffer solution in aqueous systems is formed of an appreciable concentration of a weak acid or base and its conjugate salt. When a small quantity of acid or base is added to the buffer system, the pH change is relatively small.

In the production of a photoconductive element, small amounts of acidic or basic impurities may be present in layer or layers of the photoconductive element. Oftentimes, the presence of the impurity results from the method used in the manufacturing process or raw materials used for making the photoconductive elements, such as trifluoroacetic acid. Alternatively, the impurity may be a basic compound such as triethylamine.

Variations in levels of acidic or basic impurities affect the electrical properties of the system. These variations will manifest themselves in the visual variance in $V_{DDP}$ and $V_{BG}$. For example, the quality of the copied image may be reduced because the copies are too light or too dark, or the image is distorted. Such unpredictable variations in copy quality are amplified in high volume and high speed copiers and printers. The general effect of impurities on $V_{DDP}$ and $V_{BG}$ are recognized in U.S. Pat. No. 4,725,518, the disclosure of which is incorporated herein by reference.

The variations in the electrical characteristics of the electrophotographic imaging member, such as effects of $V_{DDP}$ and $V_{BG}$, are reduced or eliminated by incorporating a buffer system in the photoconductive layer thereof. The buffer system may be incorporated into either the charge generating material or the charge transporting material of the photoconductive element of the imaging member during the production of the layer or layers of the photoconductive element.

Any suitable weak acid or base and the conjugate salt of the weak acid or base may be employed as the buffer system in the photoconductive element. Examples of weak acids are citric acid, cyclohexane-1,2-trans dicarboxylic acid, 2,4-dichlorophenol, and pyridine dicarboxylic acid. Conjugate salts are derived from, for example, dioctylamine and tetramethyl guanidine. In general, the amount of weak acid and the conjugate salt in the dispersion may be 0.5–100 ppm based on the weight of solvent. A preferred amount of weak acid and the conjugate salt in the dispersion is about 1–3 ppm based on the weight of the solvent.

Examples of weak bases are diethanoiamine and pyridine. Conjugate salts may be derived from, for example, benzene sulfonic acid or trifluoroacetic acid. In general, the amount of weak base and the conjugate salt in the dispersion is about 0.5–100 ppm based on weight of solvent. A preferred amount of weak base and the conjugate salt in the dispersion is about 1–3 ppm based on weight of solvent.

The photoconductive element containing the buffer system is formed by coating a suitable substrate with a dispersion containing at least one of a charge generating material or a charge transporting material, a solution of a weak acid or a weak base and a conjugate salt of the weak acid and the weak base, and a binder resin. The dispersion is then dried to form a photoconductive element on the substrate.

The photoconductive element may be a single layer or multilayer structure. In a preferred embodiment the photoconductive element contains a charge generating layer and a charge transporting layer supported on a substrate. In the process of forming such a photoconductive element, a first dispersion of a charge generating material in a binder resin is coated on a substrate and dried to form a charge generating layer. Then a second dispersion of a charge transporting material in a binder resin is coated on the charge generating layer and dried to form a charge transporting layer. In at least one of the first and second dispersions there is also incorporated a solution of a weak acid or a weak base and a conjugate salt of the weak acid and the weak base. The weak acid or weak base and the conjugate salt are incorporated in the dispersion in an amount effective to reduce variations in the $V_{DDP}$ and the $V_{BG}$ characteristics of the imaging members due to the presence of acidic or basic impurities in the layer formed from the dispersion in which the solution is incorporated.

To monitor the effect of the buffer system in the photoconductor the electrical properties of $V_{DDP}$ and $V_{BG}$ may be used to qualify the results. Since the present invention concerns an organic system, the pH cannot be accurately defined. However, the variations in pH correlate to variations in the systems electrical properties and directly affect the $V_{DDP}$ and $V_{BG}$.

Generally, a photoconductive element prepared with the process of this invention has two electrically operative layers on a supporting substrate. The substrate may be opaque or substantially transparent and may comprise numerous suitable materials having the required mechanical properties.

A conductive layer or ground plane which may comprise the entire supporting substrate or be present as a coating on an underlying member may comprise any suitable material including, for example, aluminum, titanium, nickel, chromium, brass, gold, stainless steel, carbon black, graphite and the like. The conductive layer may vary in thickness over substantially wide ranges depending on the desired use of the electrophotoconductive member. Accordingly, the conductive layer can generally range in thickness of from about 50 Angstroms to many centimeters.

The supporting substrate, in addition to the conductive layer, may have an underlying member. Typical underlying members include insulating nonconducting materials including various resins known for this purpose including polyesters, polycarbonates, polyamides, polyurethanes, and the like.

The supporting substrate or underlying member may also comprise a composite structure such as a thin conductive coating on a paper base, a plastic web coated with a thin conductive layer such as aluminum, nickel, or copper iodine or glass coated with a thin conductive coating of chromium or tin oxide.

The supporting substrate or underlying member may be flexible or rigid and may have any number of many different configuration such as, flexible belts or sleeves, sheets, scrolls, webs, plates, cylinders, drums, and the like. Preferably, the insulating substrate is in the form of an endless flexile belt and comprises a commercially available polyethylene terephthalate polyester known as Mylar available from E.I. du Pont de Nemours & Co.

Any suitable charge generating or photogenerating material may be employed in one of the two electrically operative layers in the multilayer photoconductive element prepared by the process of this invention. Various generating layers comprising photoconductive layers exhibiting the capability of photogeneration of holes and injection of the holes into a charge transport layer may be used. Typical charge generating materials include metal free phthalocyanine described in U.S. Pat. No. 3,357,989, metal phthalocyanines such as copper phthalocyanine, quinacridones available from DuPont under the tradename Monastral Red, Monastral Violet and Monstral Red Y, substituted 2,4-diamino-triazines disclosed in U.S. Pat. No. 3,442,781, and polynuclear aromatic quinines available from Allied Chemical Corporation under the tradename Indofast Double Scarlet, Indofast Violet Lake B, Indofast Brilliant Scarlet and Indofast Orange. Other examples of charge generator layers are disclosed in U.S. Pat. No. 4,106,934, U.S. Pat. No. 4,265,990, U.S. Pat. No. 4,233,384, U.S. Pat. No. 4,306,008, U.S. Pat. No. 4,299,897, U.S. Pat. No. 4,232,102, U.S. Pat. No. 4,233,383, U.S. Pat. No. 4,415,639, and U.S. Pat. No. 4,439,507. The disclosures of these patents are incorporated herein in their entirety.

The thickness of the charge generating and charge transporting layers can vary widely. Generally, a charge generating or charge transporting layer is about 0.1 u to 2.5 u thick. Preferably, the charge transporting layer is about 20 u to 30 u thick.

The process of dispersion milling, the application of the resulting dispersion to a substrate and the drying thereof, are further described in U.S. Pat. No. 4,543,314, the disclosure of which is incorporated herein in its entirety.

Any suitable inactive resin binder material may be employed in or between the layers of the photoconductive element. Typical organic resinous binders include polycarbonates, acrylate polymers, vinyl polymers, cellulose polymers, polyesters, polysiloxanes, polyamides, polyurethanes, epoxies, and the like. Many organic resinous binders are disclosed, for example, in U.S. Pat. No. 3,121,006 and U.S. Pat. No. 4,439,507, the entire disclosures of which are incorporated herein by reference.

In a preferred embodiment, the charge generating material comprises trigonal selenium in a polyvinylcarbazole resin and the charge transferring material comprises aromatic amines in a polycarbonate resin. The charge transporting and charge generating layers may also contain other addenda such as leveling agents, insulators, blocking layers, surfactants, plasticizers, and the like to enhance or improve various physical properties of the charge transport layer. In addition various addenda to modify the electrophotographic response of the element may be incorporated in the charge-transport layer.

In some cases, intermediate layers between the charge generating and charge transporting layer may be desired to improve adhesion or to act as an electrical barrier layer. Typical adhesive layers include film-forming polymers such as polyester, polyvinyl butyral, polyvinyl pyrrolidone polyurethane, polymethyl methacrylate and the like.

Optionally, other layers such as a protective overcoating may be provided on the photoconductive elements. These overcoating layers may comprise organic polymers or inorganic polymers that are electrically insulating or slightly semiconductive.

EXAMPLE I

Photoreceptive devices were prepared by providing a titanium metalized mylar substrate having a thickness of 3 ml and applying thereto, using a Bird applicator, a solution containing 2.592 g 3-aminopropyltriethoxysilane, 0.784 g acetic acid, 180 g of 190 proof denatured alcohol and 77.3 g heptane. This layer was then allowed to dry for 5 minutes at room temperature and 10 minutes at 135° C. in a forced air oven. The resulting blocking layer had a dry thickness of 0.05 micrometer.

An adhesive interface layer was then prepared by applying to the blocking layer a coating having a wet thickness of 0.5 ml and containing 0.5 percent by weight based on the total weight of the solution DuPont 49,000 adhesive in 70:30 volume ratio mixture of terahydrofuran/cyclohexanone with Bird applicator. The adhesive interface layer was allowed to dry for 1 minute at room temperature and 10 minutes at 100° C. in a forced air oven. The resulting adhesive interface layer had a dry thickness of 0.05 micrometer.

The adhesive interface layer was thereafter coated with a photogenerating layer containing 7.5 percent by volume trigonal selenium, 25 percent by volume N,N'-diphenyl-N,N'-bis(3methylphenyl)-1,1'-biphenyl-4,4'-diamine, and 67.5 percent by volume polyvinylcarbazole. This photogenerating layer was prepared by introducing 0.8 gram of polyvinyl carbazole and 14 ml of a 1—1 volume ratio of a mixture of tetrahydrofuran and toluene into a 2 oz. amber bottle. To this solution was added 0.8 gram of trigonal selenium and 100 grams of 1 inch diameter stainless steel shot. This mixture was then placed on a ball mill for 72 to 96 hours. Subsequently, 5 grams of the resulting slurry were added to a solution of 0.36 g of polyvinyl carbazole and 0.20 g of N,N'-diphenyl-n,N'-bis (3-methylphenyl )-1,1'-biphenyl-4,4'-diamine in 7.5 ml of 1:1 volume ratio of tetrahydrofuran/-toluene. This slurry was then placed on a shaker for 10 minutes. The resulting slurry was thereafter applied to the adhesive interface with a Bird applicator to form a layer having a wet thickness of 0.5 ml. The layer was dried at 135° C. for 5 minutes in a forced air oven to form a dry thickness photogenerating layer having a thickness of 2.0 microns.

This photogenerator layer was overcoated with a charge transport layer. The charge transport layer was prepared by introducing into an amber glass bottle in a weight ratio of 1:1 N,N'-diphenyl-N,N'-bis(3-methylphenyl)-1,1'-biphenyl-4,4'-diamine and Makrolon®, a polycarbonate resin having a molecular weight of from about 50,000 to 100,000 commercially available from Larbensabricken Bayer A.G. The resulting mixture was dissolved in 15 percent by weight methylene chloride. This solution was applied on the photogenerator layer using a Bird applicator to form a coating which upon drying had a thickness of 25 microns. During this coating process the humidity was equal to or less than 15 percent. The resulting photoreceptor device containing all of the above layers was annealed at 135° C. in a forced air oven for 6 minutes.

EXAMPLE II

Methylene chloride containing various amounts of trifhoroacetic acid was prepared by weighing 499.5 grams of reagent grade methylene chloride into a glass bottle and into this dissolving 0.5 grams of trifhoroacetic acid to obtain a solution containing 1000 ppm of acid based on methylene chloride. Appropriate dilutions of this solution were made using methylene chloride to obtain 100, 25 and 10 and 5 ppm of trifluoroacetic acid based on the weight of solvent.

EXAMPLE III

Photoreceptor control samples 2–5 were prepared as in Example 1 except the methylene chloride used for the charge transport layer was acid treated as in Example II.

EXAMPLE IV

A buffer solution was prepared containing $0.5\times10^{-3}$m diethanolamine and $5.7\times10^{-4}$m benzene sulfonic acid in methylenechloride. 0.23 grams of this buffer solution was added to 22.37 grams of untreated methylene chloride and also the four acid treated methylene chloride samples of Example II, to obtain 1.5 ppm of the diethanol ammonium salt of benzene sulfonic acid based on the weight of methylene chloride.

EXAMPLE V

Photoreceptor samples 6–10 were prepared as in Example I except the methylene chloride used for the charge transport layer was treated with acid and buffer as prepared in Example IV.

EXAMPLE VI

Methylene chloride containing various amounts of triethylamine was prepared by weighing 499.5 grams of reagent grade methylene chloride into a glass bottle and into this dissolving 0.5 grams of triethylamine to obtain a solution containing 1000 ppm of base based on methylene chloride. Appropriate dilutions of this solution were made using methylene chloride to obtain 25 ppm and 10 ppm of triethylamine.

EXAMPLE VII

Photoreceptors samples 12–13 were prepared as in Example I except the methylene chloride used for the charge transport layer was treated with triethylamine as in Example VI.

EXAMPLE VIII

A buffer solution was prepared containing $5\times10^{-3}$m mono-dicytlamine salt of cyclohexane-1,2 trans-dicarboxylic acid and $5.6\times10^{-4}$m tetramethylguanidine in methylene chloride. 0.23 grams of this buffer solution was added to 22.37 grams of untreated methylene chloride and also the two base treated methylene chloride samples of Example VI, to obtain 1.5 ppm of the mixed ammonium salt of cyclohexanone-1,2-trans-dicarboxylic acid based on the weight of methylene chloride.

EXAMPLE IX

Photoreceptor samples 14–16 were prepared as in Example I except the methylene chloride used for the charge transport layer was treated with base and buffer as in Example VIII.

EXAMPLE X

Control samples 1–5 and inventive samples 6–10 were charged with a DC corotron to a surface charge density of $1.2\times10^{-7}$ coulombs/cm$^2$. The dark development potential $V_{DDP}$ was measured 0.6 seconds after charge using an electrostatic voltmeter with the samples kept in the dark. The background potential, $V_{BG}$, was determined by charging the sample to the same current density as above in the dark, exposing 0.16 seconds later with 3.8 ERGS/cm$^2$ of white light restricted to the 400 nm to 700 nm spectral range, and measuring the surface potential at 0.6 second after charge.

As seen in Table I, the control samples prepared without the buffer solutions show sensitivity to the presence of small amounts of trifluoroacetic acid as evidenced by a continuous increase in dark decay and sensitivity accompanied by a decrease in residual voltage and increased cycle down. The samples 6–10 however show relatively little change in these properties with increase in acid concentration up to 25 ppm. Even at 100 ppm of acid the buffer solutions show less variation than the corresponding control solution.

TABLE I

| Example | ppm acid | Dark Decay | $V_{DDP}$ | $V_{BG}$ | % D | Initial $V_R/V_R$ | % Cycle down |
|---|---|---|---|---|---|---|---|
| Control 1 | 0 | 11.9 | 775 | 203 | 73.8 | 26/50 | 13.6 |
| Control 2 | 5 | 12.8 | 751 | 162 | 78.4 | 18/25 | 19.7 |
| Control 3 | 10 | 13.7 | 653 | 125 | 80.8 | 12/18 | 29.5 |
| Control 4 | 25 | 14.1 | 670 | 98 | 85.4 | 12/19 | 29.0 |
| Control 5 | 100 | 22.9 | 518 | 56 | 89.2 | 9/15 | 46.7 |
| Inventive solution 6 | 0 | 11.7 | 778 | 182 | 76.6 | 24/42 | 21.7 |
| Inventive solution 7 | 5 | 12.9 | 776 | 167 | 78.5 | 23/31 | 22.2 |
| Inventive solution 8 | 10 | 11.5 | 755 | 194 | 74.3 | 25/32 | 17.5 |
| Inventive solution 9 | 25 | 12.7 | 771 | 147 | 80.9 | 16/22 | 20.4 |
| Inventive solution 10 | 100 | 16.5 | 649 | 115 | 82.3 | 20.19 | 37.4 |

EXAMPLE XI

Samples 11–16 prepared in Examples I, VII, and IX, were tested xerographically as in Example X. The control samples 11–13 prepared without the buffer solutions show sensitivity to the presence of small amounts of triethylamine as evidenced by a continuous increase in $V_{BG}$ and sensitivity accompanied by a decrease in $V_{DDP}$ and cycle down. The samples 14–16, however, show relatively little change in these properties with increase in basic concentration up to 25 ppm.

TABLE II

| Example | ppm base | Dark Decay | $V_{DDP}$ | $V_{BG}$ | % D | Initial $V_R/V_R$ | % Cycle down |
|---|---|---|---|---|---|---|---|
| Control 11 | 0 | 12.6 | 747 | 166 | 77.6 | 22/54 | 13.0 |
| Control 12 | 10 | 10.3 | 807 | 282 | 65.1 | 41/94 | 2.3 |
| Control 13 | 25 | 9.9 | 801 | 302 | 62.3 | 43/96 | 2.3 |
| Inventive solution 14 | 0 | 12.9 | 771 | 209 | 72.9 | 30/59 | 7.9 |
| Inventive solution 15 | 10 | 11.2 | 769 | 252 | 67.2 | 39/77 | 5.0 |
| Inventive solution 16 | 25 | 11.0 | 872 | 294 | 65.9 | 43/83 | 3.4 |

Although the present invention has been described by reference to the specific embodiments and examples, those skilled in the art would readily understand that modifications may be made by one skilled in the art after a review of this description without departing from the spirit and scope of the claims which follow.

What is claimed is:

1. The method of controlling variations in the electrical characteristics of an electrophotographic imaging member due to the presence of acidic or basic impurities in a photoconductive element of the imaging member, which method comprises:

coating a substrate with a dispersion comprising at least one of a charge generating material or a charge transporting material, a solution comprising a weak acid or a weak base and a conjugate salt of the weak acid or the weak base, and a binder resin;

and drying the dispersion to form a photoconductive element on the substrate.

2. The method according to claim 1, wherein said weak acid and conjugate salt of the weak acid comprise cyclohexane-1,2-trans-dicarboxylic acid and its dioctylamine salt with tetramethyl guanidine.

3. The method according to claim 1, wherein said weak base and conjugate salt of the weak base comprise diethanol amine and its salt with benzenesulfonic acid.

4. The method according to claim 1, wherein said weak acid or weak base and a conjugate salt of the weak acid or the weak base are present in the amount of 0–3 ppm.

5. The process for producing electrophotographic imaging members, which process comprises:

forming a charge generating layer on a substrate by coating the substrate with a first dispersion of a charge generating material in a binder resin;

drying the first dispersion to form a charge generating layer;

coating the charge generating layer with a second dispersion of a charge transporting material and a binder resin; and drying the second dispersion to form a charge transporting layer;

wherein there is incorporated in at least one of the first and second dispersions a solution comprising a weak acid or a weak base and a conjugate salt of the weak acid or the weak base in an amount effective to reduce variations in the dark decay and background potential characteristics of the imaging members due to the presence of acidic or basic impurities in the layer formed from the dispersion in which the solution is incorporated.

6. The process according to claim 5, wherein said weak acid and conjugate salt of the weak acid comprise cyclohexane-1,2-trans-dicarboxylic acid and its dioctylamine salt with tetramethyl guanidine.

7. The process according to claim 5, wherein said weak base and conjugate salt of the weak base comprise diethanol amine and its salt with benzenesulfonic acid.

8. The process according to claim 5, wherein said weak acid or weak base and a conjugate salt of the weak acid or the weak base are present in the amount of about 0–3 ppm.

9. The process for producing electrophotographic imaging members, which process comprises:

forming a charge generating layer on a substrate;

applying a coating of a charge transporting layer forming a mixture to the charge generating layer, the mixture comprising a charge transporting material and a solution comprising a weak acid or a weak base and a conjugate salt of the weak acid or the weak base dispersed in a binder resin; and drying the mixture to form a charge transport layer; the amount and concentrations of the ingredients in the solution being effective to reduce variations in the dark decay and background potential characteristics of the imaging members due to the presence of acidic or basic impurities in the charge transporting layer.

10. The process according to claim 9, wherein said weak acid and conjugate salt of the weak acid comprise cyclohexane-1,2-trans-dicarboxylic acid and its dioctylamine salt with tetramethyl guanidine.

11. The process according to claim 9, wherein said weak base and conjugate salt of the weak base comprise diethanol amine and its salt with benzenesulfonic acid.

12. The process according to claim 9, wherein said weak acid or weak base and a conjugate salt of the weak acid or the weak base are present in the amount of 0–3 ppm.

13. An electrophotographic imaging member comprising a photoconductive element formed on a substrate, wherein the photoconductive element comprises a conjugate salt of a weak acid and a weak base present in an amount effective to reduce variations in the electrical characteristics of the photoconductive element due to the presence of acidic or basic impurities therein.

14. The electrophotographic imaging member according to claim 13, wherein said weak acid and conjugate salt of the weak acid comprise cyclohexane-1,2-trans-dicarboxylic acid and its dioctylamine salt with tetramethyl guanidine.

15. The electrophotographic imaging member according to claim 13, wherein said weak base and conjugate salt of the weak base comprise diethanol amine and its salt with benzenesulfonic acid.

16. The electrophotographic imaging member according to claim 13, wherein said weak acid or weak base and a conjugate salt of the weak acid or the weak base are present in the amount of 0–3 ppm.

* * * * *